US009146056B2

(12) United States Patent
Lee et al.

(10) Patent No.: US 9,146,056 B2
(45) Date of Patent: Sep. 29, 2015

(54) LAUNDRY TREATING APPARATUS HAVING EXPANSION VALVE WHICH IS VARIABLE ACCORDING TO THE DRIVING MODE

(71) Applicant: LG ELECTRONICS INC., Seoul (KR)

(72) Inventors: Hyuksoo Lee, Seoul (KR); Bio Park, Seoul (KR); Seonghwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 45 days.

(21) Appl. No.: 14/057,236

(22) Filed: Oct. 18, 2013

(65) Prior Publication Data

US 2014/0109435 A1 Apr. 24, 2014

(30) Foreign Application Priority Data

Oct. 22, 2012 (KR) ..... 10-2012-0117475

(51) Int. Cl.
*F26B 21/06* (2006.01)
*D06F 58/06* (2006.01)
*F26B 21/08* (2006.01)

(52) U.S. Cl.
CPC ..... *F26B 21/086* (2013.01)

(58) Field of Classification Search
CPC ..... F26B 7/00; F26B 19/00; F26B 21/00; F26B 21/06; D06F 58/00; D06F 58/06; D06F 58/20; F25B 49/00; F25B 45/00
USPC ..... 34/381, 413, 468, 595, 601, 606, 610; 68/12.06, 19, 20; 8/132, 149, 159; 62/84, 94, 196.3
See application file for complete search history.

(56) References Cited

U.S. PATENT DOCUMENTS

| | | | | |
|---|---|---|---|---|
| 3,426,555 | A * | 2/1969 | McCutcheon, Jr. | 68/12.08 |
| 5,806,204 | A * | 9/1998 | Hoffman et al. | 34/92 |
| 8,347,520 | B2 * | 1/2013 | Kuwabara | 34/73 |
| 8,353,114 | B2 * | 1/2013 | Beers et al. | 34/343 |
| 8,387,273 | B2 * | 3/2013 | Driussi | 34/524 |
| 8,528,227 | B2 * | 9/2013 | Beers et al. | 34/493 |

(Continued)

FOREIGN PATENT DOCUMENTS

| | | |
|---|---|---|
| CN | 2380593 Y | 5/2000 |
| CN | 1746418 A | 3/2006 |

(Continued)

OTHER PUBLICATIONS

Great Britain Search Report dated Feb. 13, 2014, issued in Application No. GB1318542.6.

(Continued)

*Primary Examiner* — Stephen M Gravini
(74) *Attorney, Agent, or Firm* — Ked & Associates, LLP

(57) ABSTRACT

A dryer is provided. The dryer may include an expansion valve that may be varied in response to changes in operation mode. The dryer may be a condensation type heat pump dryer, and, in an operation method thereof, the expansion valve may be varied according to an on/off of a solenoid valve corresponding to a selected operation mode. In a first operation mode the heater may be turned on so that heating is supplied by both the heat pump and the heater to provide for rapid drying. In a second operation mode the heater may be turned off to provide for more economical operation. By employing multiple operation modes, a required refrigerant flow rate may be controlled.

17 Claims, 4 Drawing Sheets

(56) References Cited

U.S. PATENT DOCUMENTS

| | | | | |
|---|---|---|---|---|
| 8,533,975 | B2 * | 9/2013 | Beers et al. | 34/602 |
| 8,572,865 | B2 * | 11/2013 | Beers et al. | 34/601 |
| 8,601,717 | B2 * | 12/2013 | Beers et al. | 34/419 |
| 2005/0066538 | A1 * | 3/2005 | Goldberg et al. | 34/218 |
| 2008/0235977 | A1 * | 10/2008 | Kuwabara | 34/77 |
| 2009/0301112 | A1 * | 12/2009 | Nelson | 62/112 |
| 2010/0307018 | A1 | 12/2010 | Driussi | 34/79 |
| 2011/0271719 | A1 * | 11/2011 | Fujitsuka | 68/134 |
| 2012/0017465 | A1 * | 1/2012 | Beers et al. | 34/493 |
| 2014/0109435 | A1 * | 4/2014 | Lee et al. | 34/468 |

FOREIGN PATENT DOCUMENTS

| | | | | |
|---|---|---|---|---|
| CN | 102105631 | A | 6/2011 | |
| DE | 4330456 | C1 * | 3/1995 | D06F 58/20 |
| DE | 102005041145 | A1 | 3/2007 | |
| EP | 2 586 905 | A1 | 5/2013 | |
| EP | 2586905 | A1 * | 5/2013 | |
| JP | 2007-289558 | A | 11/2007 | |
| JP | 2009-034306 | A | 2/2009 | |
| JP | 2012205630 | A * | 10/2012 | |
| WO | WO 2009/016173 | A1 | 2/2009 | |
| WO | WO 2011/072999 | A2 | 6/2011 | |
| WO | WO 2014187494 | A1 * | 11/2014 | |

OTHER PUBLICATIONS

Chinese Office Action issued in Application No. 201310492074.7 dated Jun. 30, 2015 (with English Translation).

* cited by examiner

LAUNDRY TREATING APPARATUS HAVING EXPANSION VALVE WHICH IS VARIABLE ACCORDING TO THE DRIVING MODE

CROSS-REFERENCE TO RELATED APPLICATION(S)

This application claims priority under 35 U.S.C. §119 to Korean Application No. 10-2012-0117475 filed on Oct. 22, 2012, whose entire disclosure is hereby incorporated by reference.

BACKGROUND

1. Field

This relates to a dryer, and in particular, to a heat pump type dryer having multiple operation modes and an operation method thereof.

2. Background

In a laundry treating apparatus having a drying function such as a washer or dryer, once washing and dehydration are completed, hot air may be supplied into the drum to evaporate moisture from the laundry, thereby drying the laundry. Such a dryer may include a drum rotatably provided within a cabinet, a drive motor to drive the drum, a blower fan to blow air into the drum, and a heating device to heat air conveyed into the drum. The heating device may use, for example, high-temperature electric resistance heat generated using electric resistance, or combustion heat generated by combusting gas.

Here, the dryer may be classified according to a method for processing the high temperature and humid air, and thus divided into a condensation (circulation) type dryer for condensing moisture contained in the high temperature and humid air by cooling the air below the dew point temperature through a condenser while being circulated without discharging the high temperature and humid air out of the dryer, and an exhaustion type dryer for directly discharging the high temperature and humid air having passed through the drum to the outside.

In case of the condensation type dryer, in order to condense air discharged from the drum, the process of cooling the air below the dew point temperature should be carried out to heat the air through the heating means prior to being supplied to the drum again. Here, the loss of heat energy contained in the air is generated while being cooled down during the condensation process, and an additional heater or the like is required to heat the air to a temperature required for drying.

Even in case of the exhaustion type dryer, it is required to discharge high temperature and humid air to the outside and receive outside air at normal temperature, thereby heating the air up to a required temperature level through the heating means. In particular, thermal energy transferred by the heating means is contained in high temperature air being discharged to the outside but it is discharged and wasted to the outside, thereby reducing the thermal efficiency.

Accordingly, in recent years, clothes treating apparatuses for collecting energy required to generate hot air and energy being discharged to the outside without being used have been introduced to increase energy efficiency, and a clothes treating apparatus having a heat pump system has been introduced as an example of the clothes treating apparatus. The heat pump system may include two heat exchangers, a compressor and an expansion apparatus, and energy contained in the discharged hot air is reused in heating up air being supplied to the drum, thereby increasing energy efficiency.

Specifically, in the heat pump system, an evaporator is provided at the exhaust side, and a condenser at an inlet side of the drum, and thus thermal energy is transferred to refrigerant through the evaporator and then thermal energy contained in the refrigerant is transferred to air brought into the drum, thereby generating hot air using waste energy. Here, a heater for reheating air that has been heated up while passing through the evaporator may be additionally provided therein.

When the dryer is operated according to multiple operation modes in the heat pump type clothes dryer, a user may selectively enter into a first operation mode (speed mode) or a second operation mode (eco mode).

Typically, the heater is turned on to enhance the drying performance in case of the first operation mode, and the heater is turned off to save energy in case of the second operation mode.

However, in the multiple operation modes, the same flow rate of refrigerant is circulated during the refrigerant circulation cycle in both the first operation mode and the eco mode, thereby causing a problem that a required flow rate of refrigerant cannot be controlled.

BRIEF DESCRIPTION OF THE DRAWINGS

The embodiments will be described in detail with reference to the following drawings in which like reference numerals refer to like elements wherein.

DETAILED DESCRIPTION

Figure 1:
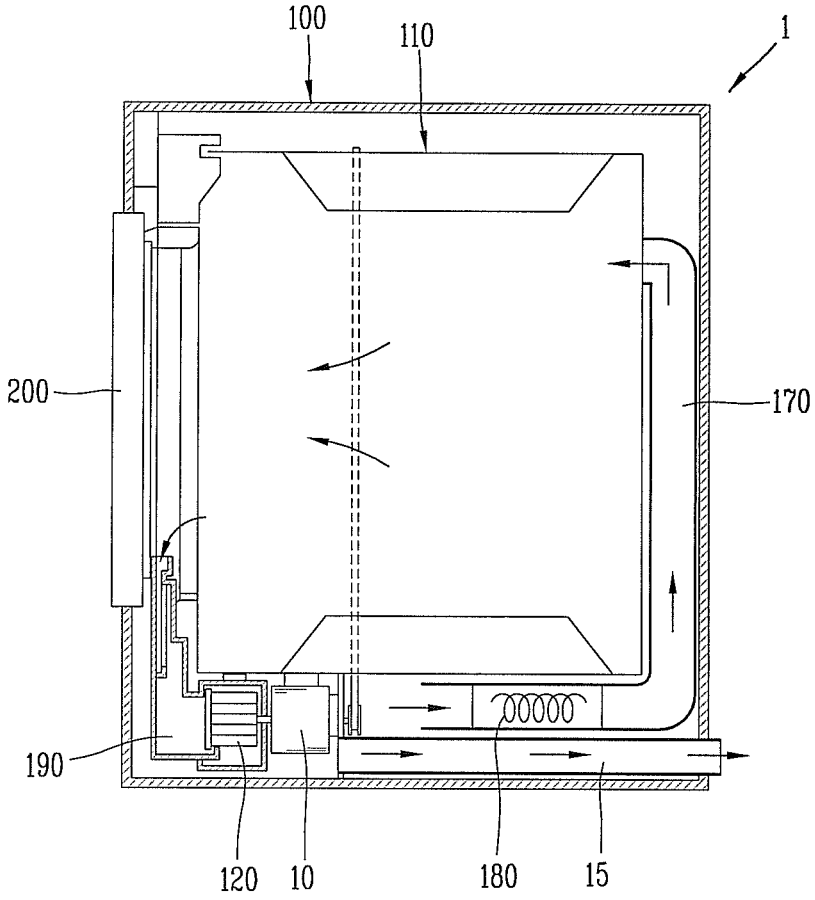
FIG. 1 is a side view of an internal structure of a heat pump type dryer.

Embodiments described herein and configurations shown the drawings are exemplary embodiments only, and do not represent all of the technical concepts as broadly described herein. Rather, it is understood that there may be various equivalents and modification examples that may replace them at the time of application.

Dryers may be classified according to a method for processing the high temperature humid air discharged from the drum as a condensation (circulation) type dryer for condensing moisture contained in the high temperature humid air by cooling the air below the dew point temperature while it circulates, without discharging the high temperature humid air out of the dryer, or an exhaustion type dryer for directly discharging the high temperature humid air from the drum to the outside.

In the condensation type dryer, in order to condense air discharged from the drum, the air may be cooled below the dew point temperature and then heated by the heating device prior to being supplied to the drum again. Here, loss of heat energy contained in the air may be generated while being cooled down during the condensation process, and an additional heater or the like may further heat the air to a temperature required for drying.

In the exhaustion type dryer, the high temperature humid air is discharged to the outside and outside air at a normal (room) temperature is drawn in and heated to a required temperature level by the heating device. In particular, residual thermal energy contained in the high temperature air being discharged to the outside may be wasted, thereby reducing thermal efficiency.

A laundry treating apparatus for collecting energy to generate hot air and unused energy being discharged to the outside may increase energy efficiency, such as, for example, a laundry treating apparatus having a heat pump system. The heat pump system may include two heat exchangers, a compressor and an expansion apparatus, and energy contained in the discharged hot air may be reused to heat air being supplied to the drum, thereby increasing energy efficiency.

Specifically, in such a heat pump system, an evaporator may be provided at the exhaust side of the drum, and a condenser at an inlet side of the drum, and thus thermal energy may be transferred to refrigerant through the evaporator and then thermal energy contained in the refrigerant may be transferred to air conveyed into the drum, thereby generating hot air using waste energy. A heater for reheating air that has been heated while passing through the evaporator may also be provided.

When the dryer is operated in one of the multiple operation modes provided, a user may selectively enter into, for example, a first operation mode (speed mode) or a second operation mode (eco mode). The heater may be turned on to enhance the drying performance in the first operation mode, and the heater may be turned off to save energy in the second operation mode. However, substantially the same flow rate of refrigerant is circulated during the refrigerant circulation cycle in both the first (speed) operation mode and the second (eco) operation mode, and thus a required flow rate of refrigerant may not be adequately controlled.

Figure 2:
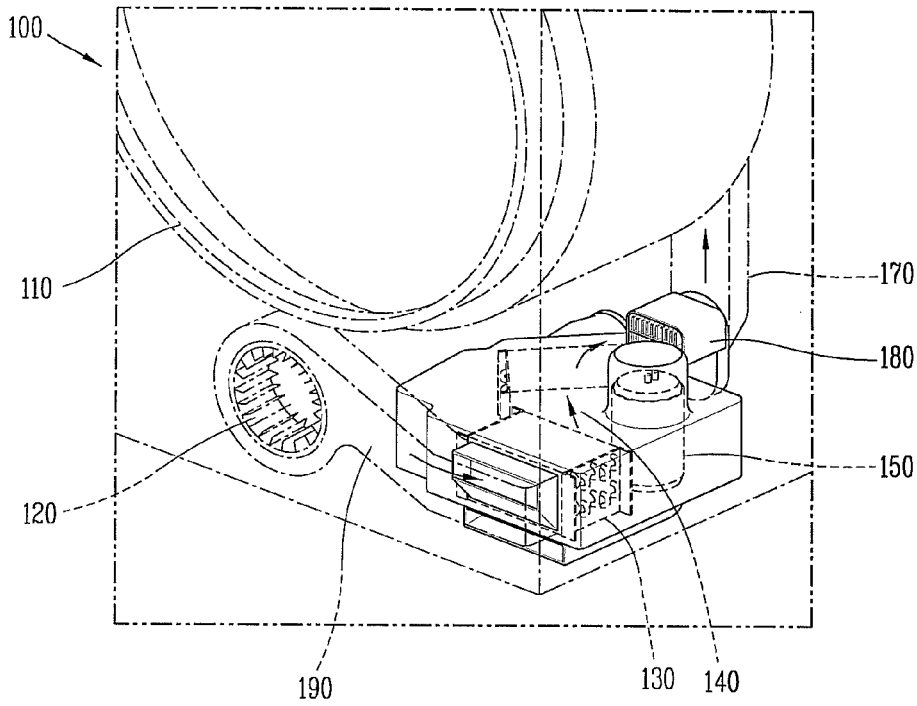
FIG. 2 is a partial detail view of a circulation type heat pump within the dryer shown in FIG. 1.
Figure 3:
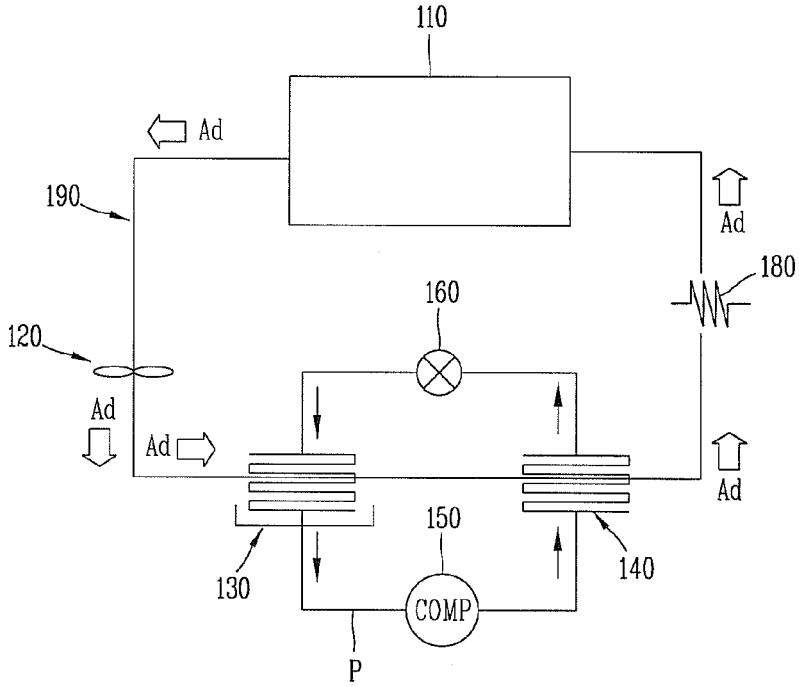
FIG. 3 is a schematic diagram of a drying method carried out by the heat pump shown in FIG. 2.

Referring to FIGS. 1 through 3, a dryer may include a cabinet 100 and a drum 110 rotatably provided within the cabinet 100. The drum 110 may be rotatably supported by a supporter, for example, at the front and rear ends thereof. An intake duct 170 may be provided in the cabinet 100 to draw outside air into the cabinet 100 and supply the air to the drum 110. The intake duct 170 may extend in the vertical direction at the rear of the drum 110, and may define an intake flow path. The air drawn in through the intake duct 170 may be drawn in from outside of the cabinet 100, separately from the drying duct 190. A heater 180 for heating the air to an adequate temperature for drying may be provided within the intake duct 170. The heater 180 may receive electrical energy to sufficiently and quickly supply heating to air to be supplied to the drum 110, and also so that the refrigerant cycle may be stably managed in a normal state.

In certain embodiments, the drying duct 190 may instead be formed as a circulation type, with no separate exhaust duct.

In the case of a circulation type drying duct 190 as described above, heating required for drying may be sufficiently supplied in a relatively short period of time, thereby reducing drying time. In other words, additional heating may be supplied in a short period of time when necessary to further heat air flowing in the circulation flow path.

The air in the drum 110 dries/absorbs moisture from the laundry and then flows into a front surface duct located at a lower front side of the drum 110, and is supplied back to the drum 110 through the drying duct 190 by way of a lint filter, or is discharged to the outside of the cabinet 100 through an exhaust duct.

A blower fan 120 to forcibly blow air to the outside of the dryer may be provided on the circulation flow path formed by the drying duct 190.

An evaporator 130 and a condenser 140 may be sequentially provided on a flow path formed by the drying duct 190. The evaporator 130 and condenser 140, forming a kind of heat exchanger, may form a refrigerant cycle of the heat pump, thereby achieving heat exchange with air (Ad) on the circulation flow path.

The air supplied to the drum 110 may be heated by the heater 180 on the intake flow path or the condenser 140 on the circulation flow path to become high-temperature dry air at about 150-250° C. when supplied back into the drum 110. The high-temperature air may contact an object to be dried to evaporate moisture therefrom. The evaporated moisture will then be contained in intermediate temperature air exhausted out of the drum 110. The moisture may be removed from this intermediate temperature humid air so that it may be circulated and re-used. Since the moisture content in the air is affected by the temperature, the moisture may be removed by cooling the air. Accordingly, the air on the circulation flow path may be cooled by heat exchange with the evaporator 130. In order to supply the air cooled by the evaporator 130 back to the drum 110 at an appropriate temperature for drying, it may be heated by high temperature air, carried out by the condenser 140.

A refrigerant cycle may perform heat exchange with the environment using phase change(s) of refrigerant. Briefly described, refrigerant may be transformed into a low-temperature and low-pressure gas by absorbing heat from the environment in the evaporator, compressed into a high-temperature and high-pressure gas in the compressor, transformed into a high-temperature and high-pressure liquid by dissipating heat to the environment in the condenser, transformed into a low-temperature and low-pressure liquid by dropping its pressure in the expansion apparatus, and brought into the evaporator again. Due to the circulation of refrigerant, heat may be absorbed from the environment in the evaporator and heat may be supplied to the environment in the condenser. The refrigerant cycle may be also referred to as a heat pump.

Such a refrigerant cycle may include the compressor 150 and expansion apparatus 160 along with the evaporator 130 and condenser 140.

The flow path of air in heat exchange with the refrigerant cycle is illustrated in FIGS. 2 and 3. In other words, an arrow passing through the evaporator and condenser and a line connecting the evaporator and condenser does not indicate the flow path of the refrigerant. Rather, these arrows indicate the flow path of the air in FIGS. 2 and 3, which is sequentially brought into contact with the evaporator 130 and the like to perform heat exchange. As shown in FIG. 3, the evaporator 130 and condenser 140 may be sequentially disposed on the circulation flow path (a large circulation line formed along a bold arrow in FIG. 3) formed by the drying duct 190.

As illustrated in FIG. 3, the air (Ad) on the circulation flow path performs heat exchange with the heat pump during the refrigerant cycle, specifically the air (Ad) on the circulation flow path dissipates heat in heat exchange with the evaporator 130, and absorbs heat in heat exchange with the condenser 140. As a result, the air on the circulation flow path re-absorbs heat it has dissipated.

In general, the evaporator 130 and condenser 140 may mainly be in charge of heat exchange during the refrigerant cycle, and the air from which heat is taken in the evaporator 130 liquefies moisture contained therein to exhaust it as condensation water, so that dry air may be heated by the compressor 150 and condenser 140 to be changed into high temperature dry air. In this manner, the high-temperature air may be provided into the drum 110 along with the air from the intake flow path to perform the drying process. Part of the air provided to the drum and used in the drying process is exhausted to the outside of the dryer 100, and part is reused.

In a heat pump type dryer as embodied and broadly described herein, waste heat may be collected using the refrigerant cycle, without causing an overload during the refrigerant cycle. In other words, the heat exchange of refrigerant may be carried out by phase change(s) at optimal operating temperature and pressure, and to this end, a heat exchanger such as an evaporator and a condenser, a compressor, an expansion apparatus and the like may be used. Accordingly, in order to collect more heat, the size of the heat exchanger or compressor may be increased. However, due to limited installation space in the dryer, the size of these components may be somewhat limited.

Accordingly, the heater 180 may be provided within the intake duct 170 to continuously replenish the inhaled air with heating. According to embodiments as broadly described herein, heating may be replenished by the heater 180 to sufficiently supply the heating required for drying, thereby reducing drying time. Furthermore, the heat exchange of refrigerant may be carried out by phase change(s) at optimal operating temperature(s) and pressure(s), and to this end, heating may be sufficiently supplied. Otherwise, it may cause a problem such as refrigerant being supplied to the compressor in a liquid phase or the like, and thus the cycle cannot be stably operated, thereby reducing the reliability of the cycle. Accordingly, as disclosed herein, the air provided to the drum may be additionally replenished with heating by the heater 180, and thus the refrigerant cycle may be stably operated in a normal state.

Figure 4:
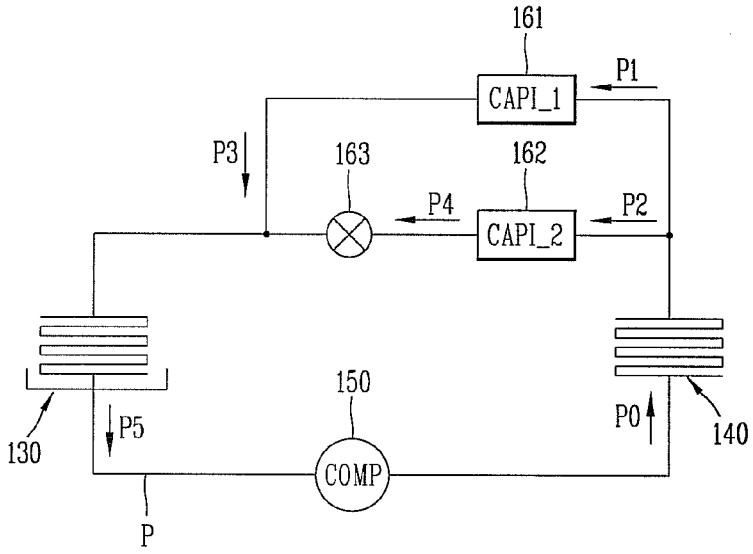
FIG. 4 is a schematic diagram of a heat pump structure including an expansion apparatus, in accordance with embodiments as broadly described herein.

In certain embodiments, the additional blower fan 120 may be provided on the intake flow path to provide more airflow, and prevent the heater 180 from overheating, as shown in FIGS. 2 through 4.

In certain embodiments, part of the air may be exhausted to the outside of the cabinet 100 upstream of the evaporator 130 on the circulation flow path. Accordingly, as illustrated in FIG. 1, the laundry treating apparatus may further include an exhaust duct 15 branched from the drying duct 190, upstream of the evaporator 130 and may exhaust part of the air to the outside of the cabinet 100. The exhaust duct 15 may form an exhaust flow path for discharging hot air coming out of the drum 110 to the outside.

According to the foregoing configuration, waste heat may be absorbed from part of the intermediate temperature humid air coming out of the drum 110 within a range that can be processed by the refrigerant cycle, and the rest of the air is exhausted. Accordingly, energy waste may be reduced overload during the refrigerant cycle may be avoided. Furthermore, it may be possible to reduce power consumption as well as enhance reliability.

In certain embodiments, an additional heater 180 may be provided to enhance drying efficiency, in particular, in an operation mode for operating the heater to promote fast drying, and whose operation may be interrupted in an operation mode for reducing energy consumption.

An increased refrigerant flow rate in the compression cycle may be needed to maximize heat exchange efficiency when the heater is operated, but it may be unnecessary to increase the flow rate of refrigerant when the heater is not operated.

Accordingly, a heat pump dryer is provided having an expansion valve that may be varied to control a flow rate of refrigerant during the refrigerant compression cycle to accommodate multiple operation modes.

Hereinafter, referring to FIGS. 4 through 6, a dryer and an operation method thereof for controlling the on/off cycles of a heater while at the same time controlling the expansion apparatus of the heat pump according to an operation mode selected from the multiple operation modes of the dryer to adjust a flow rate of refrigerant circulated through the expansion flow path of the refrigerant compression cycle will be described.

As discussed Above, a dryer as embodied and broadly described herein may include the cabinet 100, the drum 110, the drying duct 190, the heater 180, the evaporator 130, the condenser 140, the compressor 150 and the expansion apparatus 160.

As discussed above, a dryer as embodied and broadly described herein may include the cabinet 100, the drum 110, the drying duct 190, the heater 180, the evaporator 130, the condenser 140, the compressor 150, and the expansion apparatus 160. A capillary tube or linear expansion valve (LEV) may be used for an expansion valve of the heat pump dryer, which may control a degree of superheat of the refrigerant compression cycle.

In a heat pump system having, for example, a single operation mode, a compression cycle may be configured using a capillary tube to accommodate the single operation mode. A linear expansion valve (LEV) may be used for an expansion valve to accommodate multiple operation modes. However, such a linear expansion valve (LEV) may require additional operation methods and temperature sensors to control the pulse of the linear expansion valve (LEV), adding cost and complexity.

Accordingly, the expansion apparatus 160 as embodied and broadly described herein may include a first expansion valve 161 and a second expansion valve 162 having a separate refrigerant flow path, respectively, on the expansion path of the refrigerant compression cycle. The expansion apparatus 160 may also include a solenoid valve 163 provided on the path of one of the first expansion valve 161 or the second expansion valve 162 to selectively close or open the respective path, thereby changing a flow rate of refrigerant flowing through the expansion apparatus 160.

Accordingly, the multiple operation modes may include a first operation mode (Speed Mode) and a second operation mode (Eco Mode). In the first operation mode, the heater and heat pump may be operated at the same time, or the heater is may be selectively during the operation of the heat pump. In the second operation mode, only the heat pump may be operated, or the operation of the heater may be suspended during the operation of the heat pump to turn off the heater. In the first operation mode drying may be performed with the heater turned on when fast drying performance is required, and thus energy consumption may be relatively large (Speed Mode). However, in the second operation mode drying may be performed with the heater is turned off, and thus energy may be saved (Eco Mode).

As illustrated in FIG. 4, the solenoid valve 163 may be provided on a refrigerant flow path provided with the second expansion valve 162 to control the refrigerant flow path of the second expansion valve 162.

In the first operation mode (Speed Mode), the solenoid valve 163 is turned on to open the refrigerant flow path of the second expansion valve 162, so that expansion refrigerant may be circulated through the refrigerant flow path of the first expansion valve 161 as well as circulated through the refrigerant flow path of the second expansion valve 162, thereby increasing the flow path cross section through the expansion apparatus. As a result, since the cross section of the refrigerant flow path is increased during the overall expansion cycle, greater refrigerant flow is provided, and the expansion apparatus 160 may provide a flow rate of refrigerant sufficient for performing a fast drying function.

On the contrary, in the second operation mode (Eco Mode), the solenoid valve 163 may be turned off to close the refrigerant flow path of the second expansion valve 162. Accordingly, expansion refrigerant is brought into only the refrigerant flow path of the first expansion valve 161, thereby decreasing the overall flow path cross section of the expansion apparatus. In this case, the second operation mode which is an economic operation mode for reducing energy consumption, may be efficiently carried out.

Figure 5:
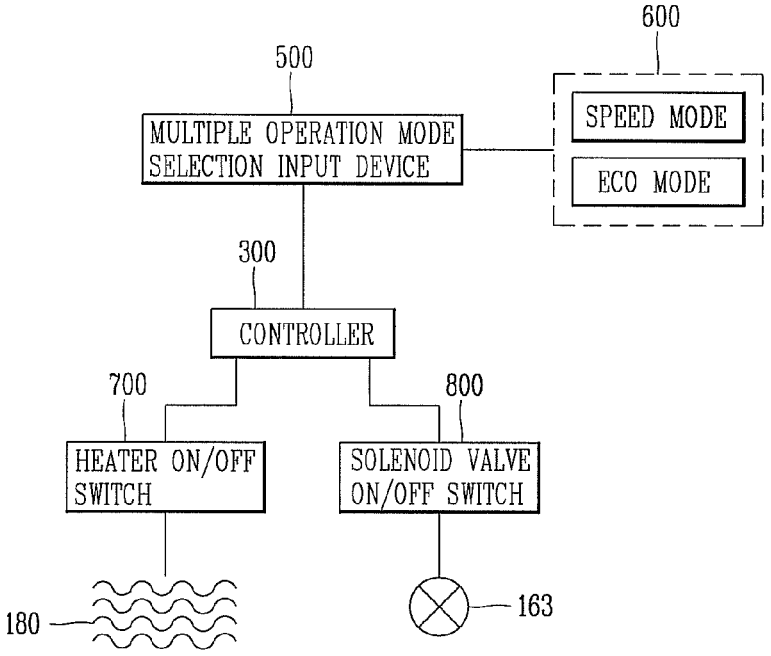
FIG. 5 is a block diagram of a control structure of a dryer, in accordance with embodiments as broadly described herein.

Referring to FIG. 5, a dryer as embodied and broadly described herein may further include a multiple operation mode selection input device 500 configured to allow the user to selectively input the operation mode of the dryer, a controller 300 configured to control the dryer in response to the user's the operation mode selection, and a solenoid valve on/off switch 800 configured to selectively turn the solenoid valve on or off in response to the command of the controller 300. The multiple operation mode selection input device 500 may be exposed to the outside of the dryer, and may be, for example, a button type or touch type to provide for easy access.

In certain embodiments, the controller 300 may also control a circulation relationship between the refrigerant compression cycle and dry air in the dryer.

The controller 300 may receive a selected operation mode from the multiple operation mode selection input device 500, and may transfer an ON command to the solenoid valve on/off switch 800 if the first operation mode is selected, and may transfer an OFF command to the solenoid valve on/off switch 800 if the second operation mode is selected. The solenoid valve on/off switch 800 may be connected with the solenoid valve 163 to selectively turn the solenoid valve 163 on or off. Here, the expansion flow path is opened when the solenoid valve 163 is turned on, and is closed when the solenoid valve 163 is turned off.

A heater on/off switch 700 may also be provided to selectively turn the heater on or off in response to the command of the controller 300. Accordingly, the controller 300 may transfer an ON command to the heater on/off switch 700 if the first operation mode is selected and may transfer an OFF command to the heater on/off switch 700 if the second operation mode is selected, thereby controlling the heater 180.

The dryer may further include a display 600 configured to externally display the selected operation mode from the multiple operation mode selection input device 500, thereby enhancing user convenience. The display 600 may be exposed on, for example, an external upper surface of the dryer, or other location as appropriate.

Hereinafter, operation of the dryer according to the multiple operation modes will be described with reference to FIGS. 3 and 4.

In the first operation mode (Speed Mode), a relatively large amount of heating is provided to the drum 110 to evaporate moisture from the wet laundry and dehumidify the evaporated moisture with the evaporator 130 within a relatively short period of time. Here, the refrigerant flow rate of the heat pump may be increased to increase a dehumidification rate, and may be achieved by increasing the flow path cross section, or flow area, of the expansion valve, which results in increased refrigerant flow.

A plurality of capillary tubes (Capi_1 and Capi_2 illustrated in FIG. 4) may be provided as expansion valves 161, 162 on an expansion flow path branched into a plurality of paths in the expansion apparatus 160.

As illustrated in FIG. 4, the expansion flow path of the expansion apparatus 160 may be branched into two paths on the refrigerant flow path of the refrigerant compression cycle, and each capillary tube may be provided on a respective branched expansion flow path.

In certain embodiments, the capillary tube may have a diameter of about 0.8-2 mm and a different length depending on the capacity, operating condition and refrigerant charge amount of the device, but typically a capillary tube with approximately 1 m, performing the role of an expansion valve in the equipment may be considered. In particular, such a capillary tube may be used for a small-sized device such as a device with a small evaporation load, such as, for example, a home refrigerator, a window type air conditioner, a refrigerated display case or the like.

Accordingly, only an ON signal (solenoid valve open) may be simply provided to the solenoid valve 163 provided on one expansion flow path when the user selects the first operation mode (Speed Mode), thereby securing the required refrigerant flow rate.

On the contrary, when the user selects the second operation mode (Eco Mode), the heater 180 may be turned off, and only heating dissipated from the condenser 140 during the operation of the heat pump may be provided for drying. In this case, only an OFF signal (solenoid valve closed) may be simply provided to the solenoid valve 163 to block refrigerant circulation through the capillary tube (Capi_2) of the second expansion valve 162, thereby controlling the refrigerant flow rate.

In the second operation mode (Eco Mode), since dehumidification on the circulation flow path of the dryer may be carried out even with a lower refrigerant flow rate compared to the first operation mode (Speed Mode), a drying operation can be carried out even with only the use of a single capillary tube (Capi_1).

Figure 6:
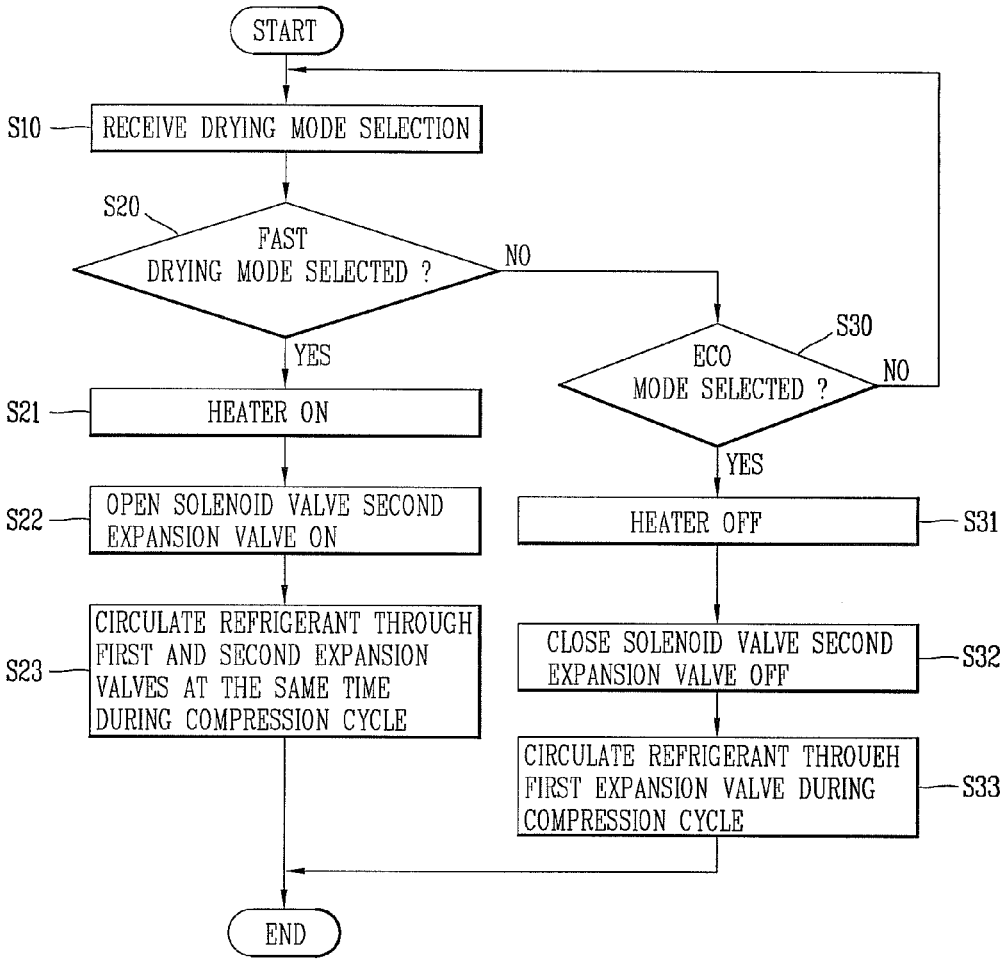
FIG. 6 is a flow chart of a method of operating a heat pump type dryer, in accordance with embodiments as broadly described herein.

As shown in FIG. 6, the on/off of the solenoid valve 163 may be controlled in connection with the control of the heater 180, thereby providing a simple and efficient control method thereof.

First, an operation mode of the dryer may be selected through the multiple operation mode selection input device 500 (S10).

Next, the controller 300 selectively turns the heater 180 on or off according to the selected operation mode (S20, S30) and then proceeds with the process of selectively turning the solenoid valve 163 on or off according to the selected operation mode (S21-S23 and S31-S33).

Accordingly, refrigerant may be circulated through the paths of the first expansion valve 161 and second expansion valve 162 at the same time during the refrigerant compression cycle, or may be circulated only through the path of the first expansion valve 161 or the path of the second expansion valve 162, depending oon the selected operation mode, thereby varying a flow rate being circulated through the expansion apparatus according to the selected operation mode of the dryer.

In selecting the operation mode of the dryer, either one of a first operation mode (Speed Mode) or second operation mode (Eco Mode) may be selected by the user, and the controller 300 may turn the heater 180 on and turn the solenoid valve 163 on when the selected operation mode is the first operation mode, and the controller 300 may turn the heater 180 off and turn the solenoid valve 163 off when the selected operation mode is the second operation mode.

In addition, refrigerant may be circulated through the paths of the first expansion valve 161 and second expansion valve 162 at the same time during the refrigerant compression cycle of the heat pump when the selected operation mode is the first operation mode, or circulated only through the first expansion valve 161 or the second expansion valve 162 when the selected operation mode is the second operation mode.

In this case, when a relatively large amount of refrigerant is circulated during the cycle, heat exchange efficiency may be increased to enhance drying performance in the first operation mode, and a suitable amount of refrigerant may be circulated during the cycle in the Eco Mode to suitably control heat exchange efficiency, thereby promoting economical efficiency.

A heat pump dryer is provided, the dryer having an expansion valve that can be changed according to an operation mode configured to control a flow rate of refrigerant being circulated in an expansion apparatus in a variable manner during the refrigerant circulation cycle by branching the path of the expansion apparatus into a first expansion valve and a second expansion valve when the dryer is selectively operated according to multiple operation modes in the clothes dryer employing a heat pump.

A dryer is provided, the dryer having an expansion valve that can be changed according to an operation mode in which the on/off of a heater is selectively controlled according to the first and the second operation mode of the clothes dryer as well as a solenoid valve is provided on one of the branched refrigerant paths in the expansion apparatus, thereby varying a flow rate being circulated in the expansion apparatus.

disclosure dryer as embodied and broadly described herein may include a cabinet; a drum rotatably provided within the cabinet; a drying duct provided in the cabinet to supply dry air to the drum; a heater configured to heat air supplied to the drum through the drying duct; an evaporator and a condenser sequentially provided on a flow path formed by the drying duct; and a compressor and an expansion apparatus configured to form a refrigerant compression cycle along with the evaporator and the condenser.

The expansion apparatus may include a first expansion valve and a second expansion valve having a separate refrigerant flow path, respectively, on the expansion path of the refrigerant compression cycle; and a solenoid valve provided on one path of the first and the second expansion valve to selectively close or open the relevant path, thereby varying a flow rate of refrigerant according to an operation mode characterized in that the solenoid valve is turned on to open both the first expansion valve and second expansion valve when the heater is turned on.

The solenoid valve may be provided in a refrigerant flow path provided with the second expansion valve to control the refrigerant flow path of the second expansion valve to be turned on or off.

The solenoid valve may be turned on to open the refrigerant flow path of the second expansion valve when the heater and the refrigerant compression cycle are operated at the same time or the heater is operated during the operation of the refrigerant compression cycle to turn on the heater, and the solenoid valve may be turned off to close the refrigerant flow path of the second expansion valve when only a heat pump is operated or the operation of the heater is suspended during the heat pump operation to turn off the heater.

In another embodiment as broadly described herein, the solenoid valve may be turned on to open the refrigerant flow path of the second expansion valve when the operation mode of the dryer is a first operation mode (Speed Mode), and the solenoid valve may be turned off to close the refrigerant flow path of the second expansion valve when the operation mode of the dryer is a second operation mode (Eco Mode).

In still another embodiment as broadly described herein, a dryer may include a multiple operation mode selection input unit configured to receive the operation mode selection of the clothes dryer; a controller configured to control the clothes dryer according to the received operation mode; and a solenoid valve on/off switch configured to selectively turn on or off the solenoid valve according to the command of the controller.

The operation mode of the dryer may include a first operation mode (Speed Mode) and a second operation mode (Eco Mode), and the controller may transfer an ON command to the solenoid valve on/off switch in case of the first operation mode, and transfer an OFF command to the solenoid valve on/off switch in case of the second operation mode The dryer may further include a heater on/off switch configured to selectively turn on or off the heater according to the command of the controller.

The controller may transfer an ON command to the heater on/off switch in case of the first operation mode, and transfer an OFF command to the heater on/off switch in case of the second operation mode to control the heater according to an operation mode received from the multiple operation mode selection input unit.

The dryer may further include a display unit configured to externally display an operation mode received from the multiple operation mode selection input unit, thereby promoting the user's convenience.

An operation method of a heat pump type dryer according to another embodiment as broadly described herein may provide an operation method for a heat pump type dryer including a cabinet, a drum, a drying duct, a heat pump, and a heater in which an expansion apparatus in the heat pump may include a first expansion valve and a second expansion valve having a separate refrigerant flow path, respectively, and includes a solenoid valve provided on one path of the first and the second expansion valve to selectively close or open the relevant path.

The dryer operation method may include selecting the operation mode selection of the dryer through a multiple operation mode selection input unit; allowing the controller to selectively turning on or off the heater according to the received operation mode; and allowing the controller to selectively turning on or off a solenoid valve according to the received operation mode, thereby controlling the heater while at the same time controlling the solenoid valve according to the operation mode.

The dryer operation method may further include allowing refrigerant to be circulated through the paths of the first expansion valve and second expansion valve at the same time during the refrigerant compression cycle or circulated only through either one of the paths of the first expansion valve and second expansion valve according to the selected operation mode, thereby varying a flow rate circulated in the expansion apparatus according to the operation mode of the clothes dryer The operation mode of the dryer may include a first operation mode (Speed Mode) and a second operation mode (Eco Mode), the controller may turn on the heater and turn on the solenoid valve when the selected operation mode is a first operation mode, and the controller may turn off the heater and turn off the solenoid valve when the selected operation mode is a second operation mode.

Refrigerant may be circulated through the paths of the first expansion valve and second expansion valve at the same time during the refrigerant compression cycle of the heat pump when the selected operation mode is a first operation mode, and refrigerant may be circulated only through either one of the paths of the first expansion valve and second expansion valve during the refrigerant compression cycle of the heat pump when the selected operation mode is a second operation mode.

According to embodiments as broadly described herein, when the dryer is selectively operated according to multiple operation modes in the dryer employing a heat pump, the path of the expansion apparatus may be branched into a first expansion valve and a second expansion valve to control a flow rate of refrigerant being circulated in an expansion apparatus in a variable manner during the refrigerant circulation cycle, thereby achieving an efficient and economic operation cycle of the dryer.

The on/off control of a heater may be selectively controlled according to the first and the second operation mode of the clothes dryer as well as a solenoid valve may be provided on one of the branched refrigerant paths in the expansion apparatus to allow the flow rate being circulated in the expansion apparatus to be varied, thereby effectively controlling the heat pump and refrigerant cycle with a very simple control structure.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dryer, comprising:

a cabinet;

a drum rotatably provided within the cabinet;

a drying duct provided in the cabinet to supply dry air to the drum;

an evaporator and a condenser sequentially provided on an air flow path formed by the drying duct;

a compressor and an expansion apparatus configured to form a refrigerant compression cycle along with the evaporator and the condenser;

a heater configured to selectively heat air supplied to the drum through the drying duct; and a controller configured to control operation of the dryer, wherein the expansion apparatus comprises:

a first expansion valve provided on a first refrigerant flow path;

a second expansion valve provided on a second refrigerant flow path; and a solenoid valve provided on one of the first refrigerant flow path or the second refrigerant flow path to selectively close or open the respective refrigerant flow path, and wherein the controller is configured to turn the solenoid valve on to open both the first expansion valve and second expansion valve when the heater is turned on, and to turn the solenoid valve off when the heater is turned off.

2. The dryer of claim 1, wherein the solenoid valve is provided in the second refrigerant flow path to open and close the second expansion valve.

3. The dryer of claim 1, wherein the controller is configured to turn the solenoid valve on to open the second refrigerant flow path when the heater and the refrigerant compression cycle are operated at the same time or the heater is turned on during the operation of the refrigerant compression cycle, and to turn the solenoid valve off to close the second refrigerant flow path when only a heat pump is operated or the heater is turned off during operation of the refrigerant compression cycle.

4. The dryer of claim 1, further comprising:

a multiple operation mode selector configured to receive an operation mode selection from a plurality of operation modes; and a solenoid valve on/off switch configured to selectively turn the solenoid valve on or off in response to the operation command generated by the controller, wherein the controller is configured to generated an operation command in response to the selected operation mode to control the dryer.

5. The dryer of claim 4, wherein the plurality of operation modes comprises a first operation mode and a second operation mode, wherein, in the first operation mode, the controller is configured to operate the heater and heat pump at the same time, or to operate the heater while the heat pump is operated, and in the second operation mode, the controller is configured to operate only the heat pump, or to suspend operation of the heater while the heat pump is operated.

6. The dryer of claim 5, wherein the controller is configured to transfer an ON command to the solenoid valve on/off switch in response to selection of the first operation mode, and to transfer an OFF command to the solenoid valve on/off switch in response to selection of the second operation mode.

7. The dryer of claim 6, further comprising:

a heater on/off switch configured to selectively turn the heater on and off in response to the operation command generated by the controller.

8. The dryer of claim 4, further comprising:

a display configured to receive the selected operation mode from the multiple operation mode selector and to externally display the selected operation mode.

9. A method of operating a dryer comprising a cabinet, a drum, a drying duct, a heat pump, a heater and an expansion apparatus in the heat pump comprising a first expansion valve and a second expansion valve having separate refrigerant flow paths and a solenoid valve provided on one of the refrigerant flow paths of the first and second expansion valves to selectively close or open the respective refrigerant flow path, the method comprising:

receiving an operation mode selection for operating the dryer;

controlling the heater and the solenoid valve in response to the received operation mode selection; and circulating refrigerant through the respective refrigerant flow paths of the first expansion valve and second expansion valve at the same time during a refrigerant compression cycle, or circulating refrigerant through only one of the refrigerant flow paths of the first expansion valve or the second expansion valve, based on the received operation mode selection.

10. The method of claim 9, wherein controlling the heater and the solenoid valve in response to the received operation mode selection comprises:

turning the solenoid valve on to open both the first expansion valve and second expansion valve when the heater is turned on; and turning the solenoid valve off to open only one of the first expansion valve or second expansion valve when the heater is turned off.

11. The method of claim 9, wherein receiving an operation mode selection for operating the dryer comprises receiving a selection of one of a plurality of operation modes, the plurality of operation modes comprising:

a first operation mode in which both the heater and heat pump are operated at the same time, or in which the heater is operated during the operation of the heat pump; and a second operation mode in which only the heat pump is operated, or in which the heater is turned off during operation of the heat pump.

12. The method of claim 11, wherein controlling the heater and the solenoid valve in response to the received operation mode selection comprises:

turning the heater on and turning the solenoid valve on in response to selection of the first operation mode; and turning the heater off and turning the solenoid valve off in response to selection of the second operation mode.

13. The method of claim 11, wherein circulating refrigerant comprises:

circulating refrigerant through the respective refrigerant flow paths of the first expansion valve and second expansion valve at the same time during a refrigerant compression cycle in response to selection of the first operation mode; and circulating refrigerant through only one of the refrigerant flow path of the first expansion valve or the refrigerant flow path of the second expansion valve in response to selection of the second operation mode.

14. A method of operating a dryer having a heat pump and an auxiliary heater, the method comprising:

receiving a selection of one of a plurality of operation modes for operating the dryer;

generating an operating command based on the selected operation mode;

controlling the auxiliary heater in accordance with the operating command; and controlling an expansion device of the heat pump in accordance with the operating command, the expansion device including a solenoid valve and first and second expansion valves, comprising:

turning the auxiliary heater on, and turning the solenoid valve on to open the first expansion valve controlling flow through a first refrigerant flow path, and circulating refrigerant through both a first refrigerant flow path on which the first expansion device is provided and the second refrigerant flow path on which the second expansion valve is provided, in a first operation mode of the plurality of operation modes; and turning the auxiliary heater off, and turning the solenoid valve off to close the second expansion valve, and circulating refrigerant through only the first refrigerant flow path, in a second operation mode of the plurality of operation modes.

15. The method of claim 14, wherein turning the auxiliary heater on in the first mode comprises turning the heater on and operating the heater continuously until completion of a corresponding drying cycle.

16. The method of claim 14, wherein turning the auxiliary heater on in the first operation mode comprises turning the heater on and operating the heater intermittently to maintain a predetermined drying temperature until completion of a corresponding drying cycle.

17. The method of claim 14, wherein turning the heater off in the second operation mode comprises turning off the heater at a predetermined point in time after circulating refrigerant through only the first refrigerant flow path.

* * * * *